US008950020B2

(12) United States Patent
D'Arrigo

(10) Patent No.: US 8,950,020 B2
(45) Date of Patent: Feb. 10, 2015

(54) BASSINET ROCKING DEVICE

(76) Inventor: Michael D'Arrigo, Roswell, GA (US)

( * ) Notice: Subject to any disclaimer, the term of this patent is extended or adjusted under 35 U.S.C. 154(b) by 410 days.

(21) Appl. No.: 13/310,038

(22) Filed: Dec. 2, 2011

(65) Prior Publication Data

US 2013/0139313 A1 Jun. 6, 2013

(51) Int. Cl.
*A47D 9/02* (2006.01)

(52) U.S. Cl.
USPC ..... 5/109; 5/105; 5/108; 5/93.1

(58) Field of Classification Search
USPC ..... 5/93.1, 98.1, 99.1, 105, 108, 109, 101, 5/104, 107; 29/428; 297/260.1, 260.2, 297/130
See application file for complete search history.

(56) References Cited

U.S. PATENT DOCUMENTS

| | | | | |
|---|---|---|---|---|
| 22,056 | A | 11/1858 | Ball | |
| 41,507 | A | 2/1864 | Helmkamp | |
| 603,002 | A | 4/1898 | Allred | |
| 652,896 | A | 7/1900 | Johnson et al. | |
| 1,374,507 | A | 4/1921 | Lawson | |
| 1,704,914 | A | 3/1929 | Fairweather | |
| 2,557,907 | A | 6/1951 | Cranfill, Jr. et al. | |
| 2,884,651 | A | 5/1959 | Garey | |
| 3,031,686 | A | 5/1962 | Muzzey | |
| 3,040,342 | A | 6/1962 | Broers | |
| 3,992,731 | A | 11/1976 | Carswell | |
| 5,553,336 | A * | 9/1996 | Mariol | 5/93.1 |
| 5,806,113 | A | 9/1998 | McMahan et al. | |
| 6,131,218 | A * | 10/2000 | Wang | 5/93.1 |
| 6,526,608 | B1 * | 3/2003 | Hsia | 5/99.1 |
| 6,728,980 | B1 * | 5/2004 | Chen | 5/93.1 |
| 7,537,285 | B2 | 5/2009 | Stewart | |
| 2003/0177574 | A1 * | 9/2003 | Waldman | 5/93.1 |
| 2004/0133977 | A1 * | 7/2004 | Rimbau Vidal | 5/98.3 |
| 2005/0011004 | A1 * | 1/2005 | Favorito (nee Wilkins) et al. | 5/94 |
| 2005/0210580 | A1 * | 9/2005 | Clapper | 5/93.1 |
| 2005/0241064 | A1 * | 11/2005 | Lopes et al. | 5/93.1 |
| 2006/0150323 | A1 * | 7/2006 | Daeseleire | 5/93.1 |
| 2006/0236461 | A1 * | 10/2006 | Ryan | 5/655 |
| 2007/0056097 | A1 * | 3/2007 | Martin et al. | 5/93.1 |
| 2008/0229496 | A1 * | 9/2008 | Wang | 5/93.1 |
| 2009/0049604 | A1 * | 2/2009 | Chen et al. | 5/93.1 |
| 2009/0113625 | A1 * | 5/2009 | Hutchinson et al. | 5/93.1 |
| 2010/0218312 | A1 | 9/2010 | Quintas Mendes | |
| 2012/0036634 | A1 * | 2/2012 | Pacella | 5/93.1 |
| 2012/0037870 | A1 * | 2/2012 | Fiore et al. | 5/93.1 |

* cited by examiner

*Primary Examiner* — Peter M Cuomo
*Assistant Examiner* — Brittany Wilson
(74) *Attorney, Agent, or Firm* — Bernhard P. Molldrem

(57) ABSTRACT

An automatic bassinet rocking device imparts a rocking motion to a bassinet or rocking crib. A housing is supported above the rocker base of the bassinet on adjustable legs so that the device straddles the curved rocking base. A reciprocating rod descends from the housing and attaches to a strap or clamp at an anchor point on the rocker base. An oscillatory drive inside the housing imparts a reciprocating motion via the reciprocating rod onto the rocker base.

9 Claims, 2 Drawing Sheets

BASSINET ROCKING DEVICE

BACKGROUND OF THE INVENTION

This invention is related to reciprocation motion devices that may be used to impart rocking motion to furniture, and is more particularly concerned with a device that may attach to a rocking cradle or bassinet to provide a gentle, soothing rocking motion. In particular, this invention is directed to a bassinet rocking device that easily installs onto the rocker bar or base of the bassinet, and creates the desired rocking motion without creep or travel, i.e., without the device causing the bassinet to walk across the floor.

Conventional rocking devices that may be used in connection with a cradle, or in some cases with a rocking chair or other furniture, typically clamp onto the base of the cradle or other item, and typically have a bar or arm or leg that moves up and down and pushes against the floor to create a rocking or "see-saw" motion. Because the reciprocating arm is moving against the floor, the device can produce a forward force, or sometimes a transverse force, that tends to move the cradle gradually across the floor.

Some alternative arrangements are employed with cradles that are suspended in a frame and do not employ the conventional (curved) rocker bars at the base. The rocking device typically is built in or has to be permanently installed in a retrofit fashion.

There is a need for an automatic, self-rocking bassinet device, sold and maintained as a separate unit, and which can be easily coupled to any existing bassinet or cradle of the type that has curved rocker bars or bases from which the main support legs rise to the body of the cradle or bassinet. The device should also be configured so it can be coupled to a child's rocking chair for automatically providing a sustained, gentle rocking motion to that item of furniture.

In addition, not one has previously provided a compact, affordable self-contained attachable unit that can be employed with all or most types of bassinet or cradle, and can provide a sustained, gentle and soothing rocking motion to satisfy the infant's comfort needs.

OBJECTS AND SUMMARY OF THE INVENTION

Accordingly, it is an object to provide an auto-rocking bassinet device that can be attached or coupled to an existing bassinet or cradle, and which overcomes the drawbacks of the devices of the prior art.

Another aspect of this invention is to provide a bassinet rocking device that stands on the floor of the room where the bassinet is located, with a main body or housing disposed over the rocker base of the unit, and with a reciprocating arm that descends from the housing and releasably clamps or connects to an anchor point on the rocker bar to gently pull the bar up and release it down, in a manner that imparts the desired rocking motion to the bassinet without causing the bassinet to walk or travel across the floor.

The unit can be battery powered, with a DC motor and a worm-gear drive within the housing to operate a crank that imparts an oscillatory motion to the reciprocating arm. The battery power can be provided from standard batteries within the housing or from an available DC power supply. Low voltage operation is desired for safety reasons. Alternatively, a spring motor can be used, wound up to provide rocking motion for at least several minutes.

According to an aspect of this invention, a bassinet rocking device is provided that connects removably with a bassinet.

The bassinet should have a rocker base, of a gently curved shape, that is supported on a floor. The legs of the bassinet rise from the rocker base and support the bassinet above the rocker base. The rocker base provides an anchor point, preferably near one of the legs, that is capable of at least limited up-and-down motion to impart a gentle rocking oscillatory motion to the bassinet.

The bassinet rocking device has a main body, i.e., a housing, with support legs that rests on the floor and support the housing at a position just above the rocker base. A strap, clamp or other equivalent coupling device removably attaches onto the anchor point on said rocker base, and a reciprocating arm connects to this coupling. The reciprocating arm has an upper end situated within the housing and has a lower portion that descends from the housing so that its lower end attaches to coupling device. The arm may be rigid or flexible.

A drive mechanism within the housing has an oscillatory portion, e.g., a wheel or crank, attached to the upper end of the reciprocating arm. This imparts a repetitive oscillatory motion onto the arm, which in turn moves the rocker base up and down to create the desired rocking motion.

In a favorable embodiment, the housing of the unit has a U-shaped recess at one end, and the recess is dimensioned to fit around one of the legs that rises from said rocker base. This allows the support legs that are positioned at each corner of the device, so that the forces of weight and rocking are directed downward and are distributed more or less evenly among the support legs, for stability. In the preferred embodiment, the support legs each includes a height adjustment mechanism to permit the height of the housing above the floor to be adjusted to an optimal height for the associated bassinet. Also, the support legs may each include a foot portion at a lower end thereof, with a resilient non-slip pad at its lower surface in contact with the floor.

Favorably, the coupling device can be in the form of a flexible strap of a sturdy woven material, and adapted to wrap around the rocker base at the anchor point. The strap may have a hook-and-loop material (e.g., Velcro) attached to it on its side facing the anchor point of the rocker base. A patch or portion of a mating hook-and-loop (e.g., Velcro) material can be attached to at the anchor point onto the rocker base.

The reciprocating arm can be a rigid rod and can include a mechanism to permit adjustment of its length.

The drive mechanism may include an electric motor within the housing, with means providing battery electric power to the electric motor, and a control circuit for controlling speed of the electric motor. There may also be a mechanism for controlling the throw or stroke length of the reciprocating motion. In one preferred mode, the oscillatory portion of the drive mechanism can be in the form of a worm gear arrangement, having a screw worm driven by the motor, a worm gear meshing with the screw worm, and a crank device driven by the worm gear. The upper end of the reciprocating arm is then coupled to the crank device.

These and other objects, features, and advantages of the invention will become apparent from the following detailed description of a selected preferred embodiment, which is to be read in connection with the accompanying Drawing:

DETAILED DESCRIPTION OF THE PREFERRED EMBODIMENTS

Figure 1:
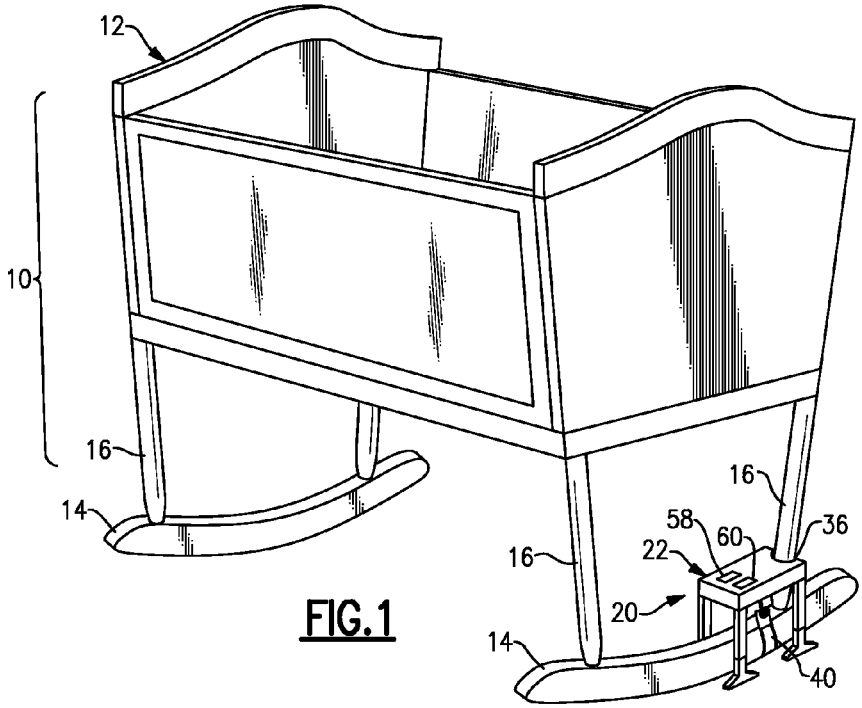
FIG. 1 is a perspective view of a bassinet or rocking cradle, shown with an associated rocking device according to one exemplary preferred embodiment of the present invention.
Figure 2:
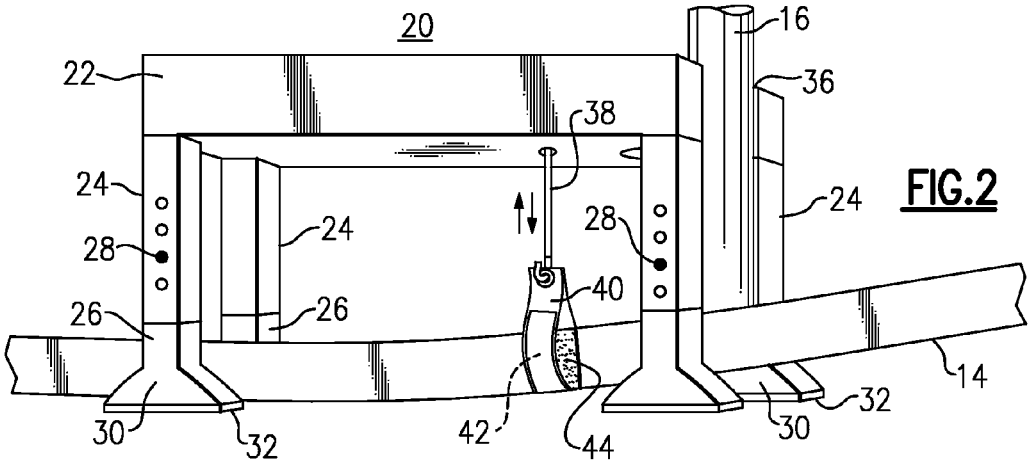
FIG. 2 is a enlarged elevational view thereof.

With reference to the Drawing Figures, and initially to FIG. 1 and FIG. 2, a cradle or bassinet 10, in general terms, has a main body 12 for holding the infant, and has a pair of curved rockers or rocker bases 14. There are legs 16 that are affixed into the bases 14, and these rise up from the rocker bases to support the body 12. The curved lower side of each rocker base 14 has a curvature radius that allows at least a limited amount of rocking motion. Here, the bases are disposed transversely, so the rocking is along the longitudinal or roll axis, but in other versions the rockers can be disposed along the fore-and-aft direction, so that rocking occurs on the transverse or pitch axis.

An automatic rocking device 20 according to this invention is shown attached to one of the rocker bases 14 at an anchor point that is at or near one of the bassinet legs 16. The rocking device 20 has a main body or housing 22, depicted in this embodiment as an elongated generally flat member, and which has four legs 24, one at each corner, that rest on the floor, straddling the rocker base 14, to support the housing at a small distance above the rocker base 14. Each support leg has an inner slide 26 that can be extended out to adjust the length of the support leg 24. In this example, each leg 24 has an engaging detent 28, in the form of a spring-loaded button, to hold the leg in the selected elevated position. At the lower end of each leg 24 is a foot member 30, with a resilient pad 32 of rubber or soft pliable plastic material. The pads 32 contact the floor, and these provide friction to help keep the device 20 in place on the floor.

A U-shaped recess 36 is provided at one end of the housing 22, and permits that end of the housing to extend at least partly around the associated bassinet leg 16.

A reciprocating rod 38 projects downward through an opening in the lower side of the housing 22 and attaches to a clamping device that is affixed onto the anchor point on the rocker base 14. In this example, the clamping device includes a flexible strap 40 that wraps over the rocker base, and grommets at the end of the strap fit onto a hook at the lower end of the reciprocating rod 38. In this embodiment, a strip 42 of a hook-loop material, e.g., Velcro is sewn onto the inner or rocker-facing surface of the strap 40. Favorably, this can be the loop material, and one or more patches 44 of the corresponding hook material can be affixed onto the sides of the rocker base at the anchor point.

Figure 3:
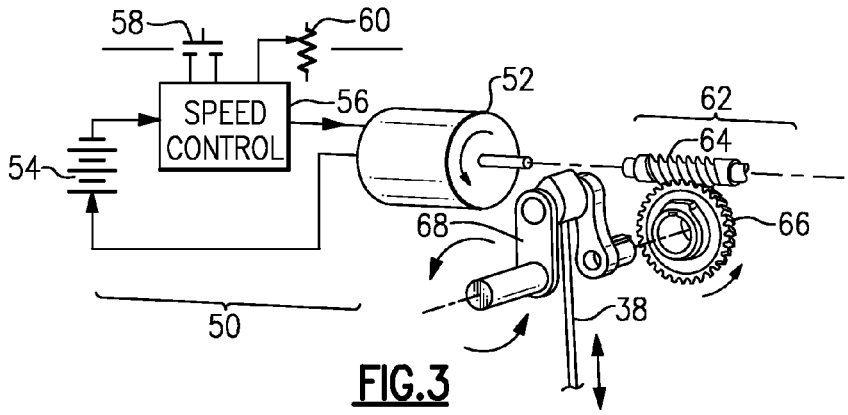
FIG. 3 is a schematic view of the motor and oscillatory mechanism thereof.

A motorized reciprocating mechanism 50 contained within the housing 22 of the device imparts a rhythmic up-and-down oscillatory motion onto the reciprocating rod 38. This mechanism 50 can be implemented as a battery-operated DC motor drive, as illustrated schematically in FIG. 3. Here, the reciprocating mechanism includes a DC motor 52, receiving power from a source 54 of battery power, which is here represented as a battery but could be implemented with an external source of low-voltage electric power. The battery power is supplied to a control circuit 56, e.g., a speed control, which may have an associated on-off switch 58 and a speed control selector 60. Here the latter selector 60 is represented schematically as a variable resistance or potentiometer, but in practical implementations this could be a digital control that would change motor speeds incrementally up or down. In FIG. 1, the on-off switch 58 and speed control selector 60 are shown implemented as push buttons on the top of the rocking device housing 22.

The shaft of the motor 52 is coupled to a worm drive 62, namely a worm screw 64 that engages the teeth of an associated worm gear or worm wheel 66. The worm wheel 66 in turn rotates a crank mechanism 68, and the upper end of the reciprocating rod 38 is attached onto a crank pin on the crank mechanism. The worm drive 62 serves as a compact and effective transmission for providing low speed oscillatory motion with sufficient torque for the rod 38 to lift and lower the anchor point of the associated rocker base 14.

The reciprocating rod 38 and strap 40 gently pull up on the rocker base to lift is a suitable distance, and then gently lower the rocker base, effecting a gentle, comforting rocking motion that is satisfying to the infant that is placed in the bassinet 10.

The reciprocating rod can be implemented as a two-piece threaded rod, so that its length can be adjusted by twisting its lower end to lengthen or shorten it, as needed. In some embodiments, the throw or stroke of the crank 68 may be adjustable to achieve a desired amount or rocking motion.

The rocking device 20 of this invention has its non-moving feet 30 holding steady onto the floor of the room on either side of the rocker bar or rocker base 14, and the reciprocating mechanism and reciprocating rod 38 simply raise and lower the rocker base at the anchor point. This motion produces far less travel or "walking" of the bassinet or cradle than do the devices of the prior art that push intermittently up and down against the floor, so with this device the bassinet or cradle is much more likely to remain at the same spot.

The rocking device can be used with any existing rocking bassinet or cradle, as the device 20 rests on the floor and only connection that needs to be made to the cradle is to attach the patch 44 of Velcro or other hook-and-loop material at the anchor point and to wrap the strap 40 around the rocker base at that point. These patches of hook-and-loop material are typically provided with an adhesive backing, and are quickly installed without difficulty.

The battery-operated device, as shown and described, is preferred, but a wind-up spring motor-powered drive could be employed in some cases.

Figure 4:
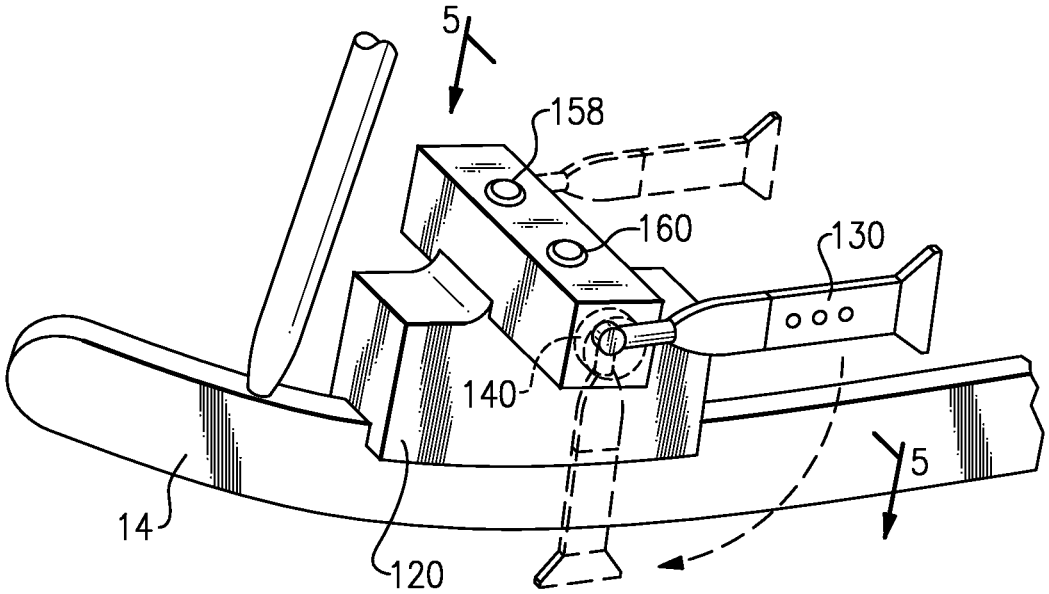
FIG. 4 is a perspective view of an alternative embodiment.
Figure 5:
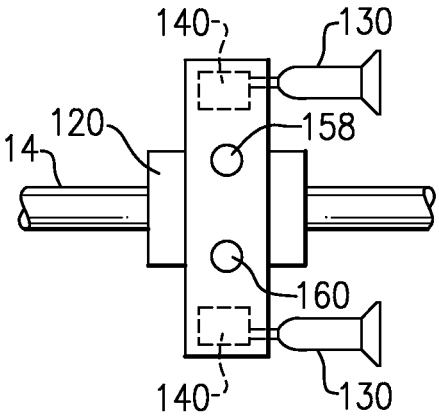
FIG. 5 is a top view thereof taken at line 5-5 of FIG. 4.

An alternative embodiment shown in FIGS. 4 and 5 is a rocker device having a housing 120 that is integrated into the rocker base 14. This embodiment employs a rotating arm as in the first embodiment, with the leg fully housed so that the portions of the housing 120 overhang the sides of the rocker base. Various methods may create up and down motion. In this version, adjustable length leg or legs 130, positioned on one or both sides, have their upper or distal ends attached to a rotary drive 140 within the housing. The leg or legs 130 swing up and lock into place when not needed, and can be moved down for use in rocking the bassinet. A speed knob 158 and timer knob 160 are positioned on the top of the housing.

While the present invention has been described with reference to several specific preferred embodiments, it should be understood that the invention is not limited to those precise embodiments. Rather, many modifications and variations would present themselves to persons skilled in the art without departure from the scope and spirit of this invention, as defined in the appended claims.

I claim:

1. A bassinet rocking device that removably connects with a bassinet of the type having a rocker base supported on a floor and legs rising from the rocker base that support a main cradle body of the bassinet above the rocker base to define an open space between the rocker base and the main cradle body, the rocker base having at least one portion thereof being capable of at least limited up-and-down motion to impart a rocking oscillatory motion to the bassinet; the rocking device comprising:

a housing;

one or more support legs each resting on the floor and attached onto and supporting the housing above said rocker base such that the housing is disposed at a steady position at a predetermined fixed distance above the floor in the space between the rocker base and the main cradle body and out of contact with the rocker base and out of contact with the main cradle body;

a coupling device free of said housing that removably attaches onto an anchor point on said rocker base;

a reciprocating arm having an upper end within said housing and which descends therefrom to a lower end that attaches to said coupling device;

a drive mechanism disposed within said housing and having an oscillatory portion attached to the upper end of said reciprocating arm for imparting oscillatory lifting motion onto said arm and to said rocker base rhythmically lifting the rocker base towards said housing and lowering said rocker base.

2. The bassinet rocking device of claim 1 wherein said housing has a U-shaped recess at one end dimensioned to fit around one of the legs that rises from said rocker base and providing a clearance around said leg and out of contact therewith.

3. The bassinet rocking device of claim 1 wherein said one or more support legs each includes a height adjustment mechanism to permit the height of the housing above the floor to be adjusted.

4. The bassinet rocking device of claim 1 wherein said one or more support legs each include a foot portion at a lower end thereof having a resilient non-slip pad at lower surface in contact with said floor.

5. The bassinet rocking device of claim 1 wherein said coupling device includes a flexible strap adapted to wrap around said rocker base at said anchor point, and having a hook-and-loop material attached to it on a side facing the anchor point of said rocker base.

6. The bassinet rocking device of claim 5 further comprising a portion of a mating hook-and-loop material attached to said rocker base at said anchor point.

7. The bassinet rocking device of claim 1 wherein said reciprocating arm includes a rigid rod that includes a mechanism to permit adjustment of its length.

8. The bassinet rocking device of claim 1 wherein said drive mechanism includes an electric motor within said housing, means providing battery electric power to said electric motor, and a control circuit for controlling speed of the electric motor.

9. The bassinet rocking device of claim 1 wherein the oscillatory portion of said drive mechanism includes a worm gear having a screw worm driven by said motor, a worm gear meshing with said screw worm, and a crank device driven by said worm gear, wherein the upper end of said reciprocating arm is coupled to said crank.

* * * * *